US010329948B2

(12) United States Patent
Howell et al.

(10) Patent No.: US 10,329,948 B2
(45) Date of Patent: Jun. 25, 2019

(54) STAMPED VARIABLE GEOMETRY TURBOCHARGER LEVER USING RETENTION COLLAR

(71) Applicant: BORGWARNER INC., Auburn Hills, MI (US)

(72) Inventors: Ryan Howell, Hendersonville, NC (US); Eli Morgan, Leicester, NC (US); Donald Michael Kennedy, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 678 days.

(21) Appl. No.: 15/040,694

(22) Filed: Feb. 10, 2016

(65) Prior Publication Data

US 2017/0226888 A1 Aug. 10, 2017

(51) Int. Cl.
*F01D 17/16* (2006.01)
*F02B 37/24* (2006.01)

(52) U.S. Cl.
CPC ..... *F01D 17/165* (2013.01); *F02B 37/24* (2013.01); *F05D 2220/40* (2013.01)

(58) Field of Classification Search
CPC ..... F01D 17/165
See application file for complete search history.

(56) References Cited

U.S. PATENT DOCUMENTS

| | | | | |
|---|---|---|---|---|
| 3,029,067 | A * | 4/1962 | Parker | F01D 17/165 415/136 |
| 4,979,874 | A | 12/1990 | Myers | |
| 5,044,880 | A | 9/1991 | McKean | |
| 6,623,239 | B2 | 9/2003 | Sahay et al. | |
| 6,699,010 | B2 | 3/2004 | Jinnai | |
| 7,044,708 | B2 * | 5/2006 | Hausknecht | F01D 17/165 415/1 |
| 7,117,596 | B2 | 10/2006 | Ohishi | |
| 7,771,161 | B2 | 8/2010 | Battig et al. | |
| 8,104,280 | B2 | 1/2012 | Akita | |
| 8,727,711 | B2 * | 5/2014 | Boning | F01D 17/165 415/164 |
| 9,175,578 | B2 * | 11/2015 | Igarashi | F01D 17/105 |
| 2012/0315164 | A1 | 12/2012 | Mayernick et al. | |
| 2015/0125275 | A1 * | 5/2015 | Ueda | F01D 17/165 415/158 |

FOREIGN PATENT DOCUMENTS

| | | | | |
|---|---|---|---|---|
| DE | 102011109704 A1 | 2/2013 | | |
| WO | WO 2014105378 A1 * | 7/2014 | | F01D 17/165 |

* cited by examiner

*Primary Examiner* — Justin D Seabe
(74) *Attorney, Agent, or Firm* — Miller, Matthias & Hull LLP

(57) ABSTRACT

A pivot shaft assembly for a turbocharger with variable turbine geometry (VTG) is provided. The pivot shaft assembly may include a pivot shaft, a pivot fork extending from the pivot shaft, a VTG lever disposed on the pivot shaft, and a retention collar axially coupled to the pivot shaft such that the VTG lever is axially aligned with the retention collar and the pivot shaft.

12 Claims, 3 Drawing Sheets

STAMPED VARIABLE GEOMETRY TURBOCHARGER LEVER USING RETENTION COLLAR

TECHNICAL FIELD

The present disclosure relates generally to turbochargers with variable geometry, and more particularly, to pivot shaft assemblies and methods of manufacturing same.

BACKGROUND

Turbochargers are a type of forced induction system which deliver air to the engine intake at greater density than would be possible in the normally aspirated configuration. In general, turbochargers include a turbine housing having a turbine inlet and a turbine wheel for receiving exhaust flow from the engine exhaust manifold, as well as a compressor housing having a compressor inlet and a compressor wheel for receiving filtered air. More specifically, the flow of exhaust gases through the turbine housing drives the turbine wheel, which in turn drives the compressor wheel to draw filtered air into the compressor housing. Spent exhaust gases are extracted from an exducer of the turbine housing and through the downpipe of the vehicle exhaust system, while compressed inlet air is released through a compressor discharge and delivered to the engine intake usually via an intercooler.

The power developed by the turbine stage is a function of the expansion ratio across the turbine stage, which is the expansion ratio from the turbine inlet to the turbine exducer. The range of the turbine power is a function of, among other parameters, the flow through the turbine stage. The power generated by the turbine stage to the shaft and wheel drives the compressor wheel to produce a combination of static pressure with some residual kinetic energy and heat. By allowing more fuel to be combusted, the power that is output from a given engine can be increased without significantly increasing engine weight. Moreover, because a smaller turbocharged engine can replace larger normally aspirated engines, turbochargers also enable notable reduction in the mass and aerodynamic frontal area of the vehicle. Due to these and other advantages, turbocharger systems are repeatedly chosen over naturally aspirated arrangements, and incremental improvements for turbochargers continue to be developed.

In its most basic form, a turbocharger employs a fixed turbine housing, where the shape and volume of the turbine housing volute is determined at the design stage and cast in place. The fixed turbine housing is the most cost-effective option simply because it has the fewest parts. In one improvement, the volute is cast in place, but the volute is fluidly connected to the exducer by a duct and flow through the duct is controlled by a wastegate valve. Because the outlet of the wastegate duct is on the exducer side of the volute, which is downstream of the turbine wheel, flow through the wastegate duct is able to bypass the turbine wheel without contributing to the power delivered to the turbine wheel. In further improvements, rotating vanes, sliding sections or rings, or adjusting guide vanes are used to adjust the geometry of the turbine. Some conventional turbochargers with adjustable geometries include variable geometry turbines or turbochargers (VGTs), variable nozzle turbines (VNTs), and other turbochargers having variable geometry (VG) or variable turbine geometry (VTG).

In general, a VTG turbocharger employs adjustable guide vanes mounted to rotate between a pair of vane rings and/or one vane ring and a nozzle wall. The vanes are adjusted to control the exhaust gas backpressure and the turbocharger speed by modulating the exhaust gas flow to the turbine wheel. In many configurations, the vanes are rotated through vane lever assemblies, which are coupled to an adjustment ring, which is further rotated via a pivot shaft assembly that is linked to an actuator. As shown for example in FIG. 1, a conventional pivot shaft assembly 100 may include a pivot shaft 102, a pivot fork 104, a VTG lever 106 pivotally extending from the pivot shaft 102, and one or more bushings 108. The pivot shaft assembly shown in FIG. 1 and the lever thereof is typically required to maintain friction or press fitments that are sufficient to translate torque through the adjustment ring and to the corresponding vanes. In order to satisfy these criteria, the lever and the geometry thereof may need to be carefully formed using more costly and time-consuming processes such as metal injection molding (MIM), powder metallurgy (PM), or the like, and cannot be formed by stamping or other more cost-efficient and simple processes.

Accordingly, there is a need to provide a turbocharger with all of the benefits associated with variable geometries, but at even less cost and delay in manufacturing same. The present disclosure is directed at addressing one or more of the deficiencies and disadvantages of the prior art set forth above. However, it should be appreciated that the solution of any particular problem is not a limitation on the scope of this disclosure or of the attached claims except to the extent express noted.

SUMMARY OF THE DISCLOSURE

In one aspect of the present disclosure, a pivot shaft assembly for a turbocharger with variable turbine geometry (VTG) is provided. The pivot shaft assembly may include a pivot shaft, a pivot fork extending from the pivot shaft, a VTG lever disposed on the pivot shaft, and a retention collar axially coupled to the pivot shaft such that the VTG lever is axially aligned with the retention collar and the pivot shaft.

In another aspect of the present disclosure, a pivot shaft assembly for a VTG turbocharger with is provided. The pivot shaft assembly may include a pivot shaft, a pivot fork extending from the pivot shaft, a VTG lever disposed on the pivot shaft, a retention collar axially coupled to the pivot shaft such that the VTG lever is axially aligned with the retention collar and the pivot shaft, and a support collar axially coupled to the mounting shaft such that the vane lever is disposed between the retention collar and the support collar.

In yet another aspect of the present disclosure, a method of manufacturing a pivot shaft assembly for a VTG turbocharger is provided. The method may include providing a pivot shaft, stamping a VTG lever sized to axially receive the pivot shaft, providing a retention collar sized to axially receive the pivot shaft, and coupling the VTG lever onto the pivot shaft using the retention collar.

These and other aspects and features will be more readily understood when reading the following detailed description in conjunction with the accompanying drawings.

While the following detailed description will be given with respect to certain illustrative embodiments, it should be understood that the drawings are not necessarily to scale and the disclosed embodiments are sometimes illustrated diagrammatically and in partial view. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as equivalents thereto.

DETAILED DESCRIPTION

Figure 2:
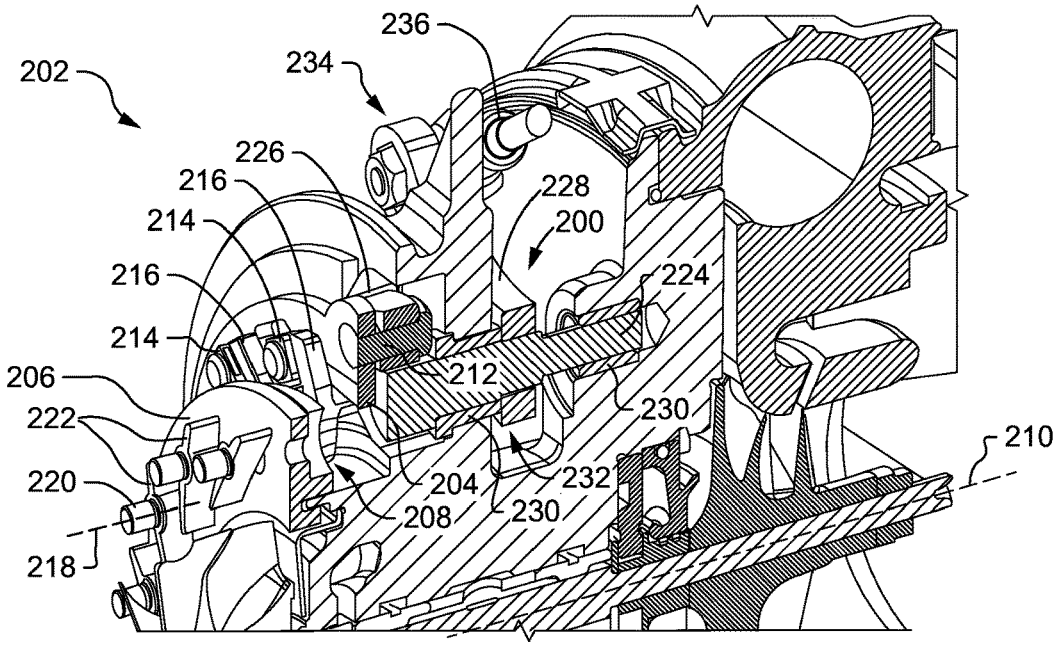
PRIOR ART FIG. 2
FIG. 2 is a partial cross-sectional perspective view of a turbocharger having variable geometry and employing one exemplary pivot shaft assembly constructed in accordance with the teachings of the present disclosure.

Referring first to FIG. 2, an example embodiment of a prior art pivot shaft assembly 200 as implemented into a turbocharger having variable geometry, or variable turbine geometry (VTG) 202 is provided. As shown, the turbocharger 202 may include an adjustment ring 204, a vane ring 206, and a plurality of vane lever assemblies 208. More specifically, the adjustment ring 204 may be rotatable about the turbocharger centerline 210 relative to the associated vane ring 206, such as via a circumferential motion of one or more adjustment pins 212, or the like. Furthermore, rotation of the adjustment ring 204 may be configured to cause a plurality of pivot blocks 214 to circumferentially rotate about the turbocharger centerline 210, thereby also causing each of the vane lever 216 coupled thereto to rotate about the respective vane shaft centerline 218. Moreover, rotating the vane levers 216 about the vane shaft centerlines 218 may cause the corresponding vane shafts 220 and vanes 222 to rotate, pivot or otherwise change position relative to the turbocharger 202.

As shown in FIG. 2, the prior art pivot shaft assembly 200 may be used to circumferentially rotate the adjustment pin 212 and thus the adjustment ring 204 about the turbocharger centerline 210, so as to ultimately cause the vanes 222 to rotate, pivot, or adjust position relative to the turbocharger 202. The pivot shaft assembly 200 may generally include a pivot shaft 224, a pivot fork 226, a VTG lever 228 and one or more bushings 230. The pivot shaft 224 may axially extend from the adjustment ring 204 and attach to the VTG lever 228. The pivot fork 226 may extend radially outwardly from the end of the pivot shaft 224 most proximate to the adjustment ring 204, and configured to couple to the adjustment pin 212 of the adjustment ring 204. The VTG lever 228 may be configured with a support end 232 and a linkage end 234, where the support end 232 is disposed on or coupled to the pivot shaft 224, and where the linkage end 234 of the pivot shaft 224 is coupled to a linkage 236 that is actuatable by an actuator not depicted. The bushings 230 may be axially and rotatably coupled to the pivot shaft 224 and configured to at least partially support and axially align the VTG lever 228 relative to the pivot shaft 224.

Figure 3:
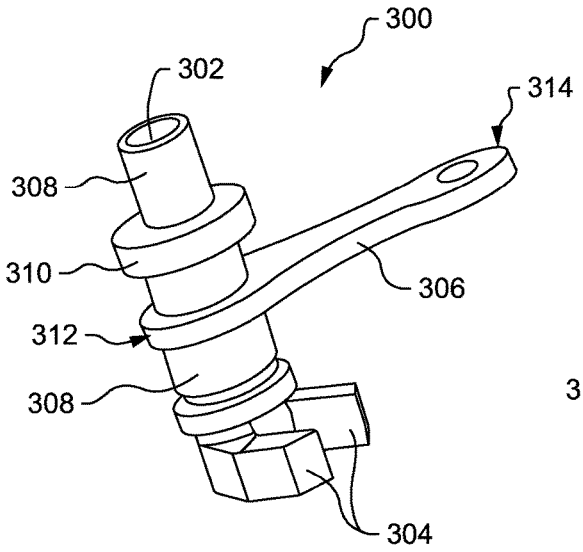
FIG. 3 is a partial perspective view of another exemplary pivot shaft assembly constructed in accordance with the teachings of the present disclosure.

Turning now to FIG. 3, one exemplary embodiment of an improved pivot shaft assembly 300 that is constructed in accordance with the present disclosure and that may be used in conjunction with a modified or a conventional turbocharger 202 is provided. As shown, the pivot shaft assembly 300 may generally include at least a pivot shaft 302, a pivot fork 304, a VTG lever 306, one or more bushings 308 and a retention collar 310. The pivot shaft 302 may axially extend from the adjustment ring 204 and attach to the VTG lever 306. The pivot fork 304 may extend radially outwardly from the end of the pivot shaft 302 most proximate to the adjustment ring 204, and may be configured to couple to or otherwise engage the adjustment pin 212 of the adjustment ring 204. The VTG lever 306 may be configured with a support end 312 and a linkage end 314, where the support end 312 is disposed on or coupled to the pivot shaft 302, and where the linkage end 314 of the pivot shaft 302 is coupled to an actuator via a linkage 236. The bushings 308 may be axially coupled to the pivot shaft 302 and configured to at least partially support and axially align the VTG lever 306 relative to the pivot shaft 302.

Figure 1:
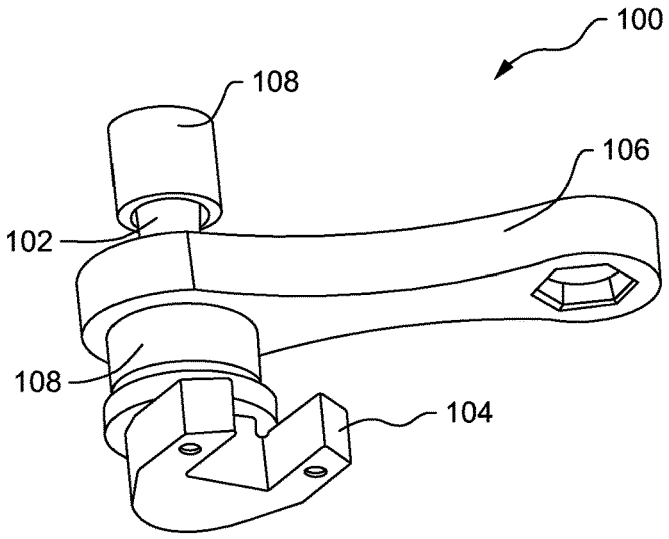
PRIOR ART FIG. 1
FIG. 1 is a partial perspective view of a pivot shaft assembly of the prior art.

In contrast to prior art pivot shaft assemblies 100, 200 as shown in FIGS. 1 and 2, the pivot shaft assembly 300 in FIG. 3 may employ a retention collar 310 to further support the VTG lever 306 relative to the pivot shaft 302. As shown in FIG. 3, the retention collar 310 may be axially coupled to one or more of the pivot shaft 302 and the VTG lever 306, and designed to interface with the pivot shaft 302 and/or the bushings 308 in a manner configured to align the VTG lever 306 with each of the retention collar 310 and the pivot shaft 302. As further shown in FIG. 4 for example, the retention collar 310 may be configured to axially couple onto the pivot shaft 302, while also rigidly abutting the VTG lever 306 onto the pivot shaft 302 or an enlarged section thereof. Alternatively, as shown for example in FIG. 5, the retention collar 310 may be configured to axially couple onto pivot shaft 302, while the VTG lever 306 may be rigidly coupled onto the outer circumference of the retention collar 310.

Figure 4:
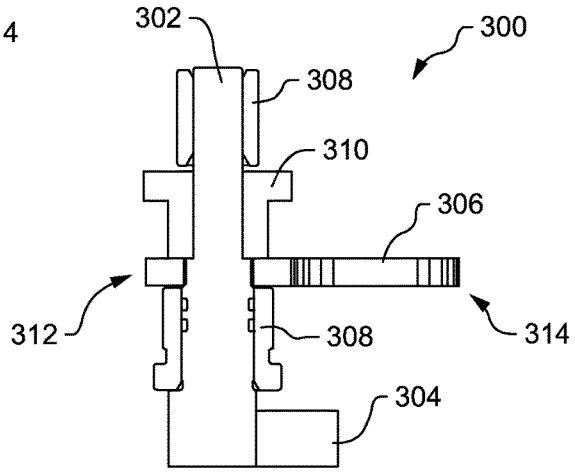
FIG. 4 is a partial cross-sectional view of the exemplary pivot shaft assembly of FIG. 3.

In either arrangement, the retention collar 310 may be rigidly coupled to one or more of the VTG lever 306 and the pivot shaft 302 via press-fitting, welding, clinching, or any other suitable technique sufficient to maintain rigid and proper alignment of the VTG lever 306 and to ensure effective torque transfer between the pivot shaft 302 and the VTG lever 306. Also, while the bushings 308 may be omitted, if one is provided, the retention collar 310 may be configured to function in conjunction with the bushings 308 to further support and align the VTG lever 306. As shown in the embodiment of FIG. 4 for example, the retention collar 310 may be configured to abut the VTG lever 306 at least partially against the bushings 308, or such that the VTG lever 306 is disposed and supported between the retention collar 310 and the bushings 308. While only certain arrangements are provided, other comparable and suitable arrangements will be apparent to those of ordinary skill in the art.

Figure 5:
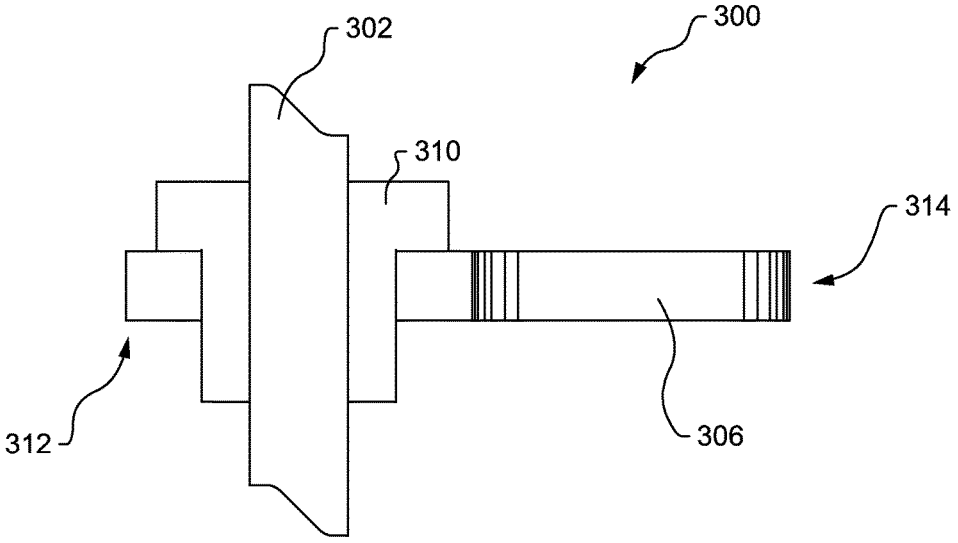
FIG. 5 is a partial cross-sectional view of another exemplary pivot shaft assembly constructed in accordance with the teachings of the present disclosure.

Still referring to FIGS. 3-5, the added support and axial reinforcement provided by the retention collar 310 may further enable the design of the VTG lever 306 itself to be significantly more simple than in prior art assemblies without compromising structural integrity or exhibiting other adverse effects. As shown in each of the embodiments of FIGS. 3-5, and as compared to the prior art VTG lever 106 of FIG. 1, the overall thickness of the VTG lever 306 is substantially more thin, and the geometry or construction of the VTG lever 306 is relatively more simple. Moreover, because the VTG lever 306 encompasses a reduced thickness as well as a less complex design and geometry, the VTG lever 306 may be constructed using faster, easier and more cost efficient manufacturing techniques or processes, such as stamping, or the like. For example, the VTG lever 306 of the present disclosure may have approximate thicknesses of less than 4 mm, thicknesses achievable via stamping processes, and still enable sufficient torque transfer to the VTG lever 306, whereas those of the prior art may need to be approximately 6-8 mm in thickness, thicknesses unachievable via typical stamping processes, in order to provide comparable torque transfer. Techniques or processes other than stamping, that are capable of manufacturing the overall reduced thickness of the VTG lever 306 disclosed herein at reduced cost, will be apparent to those of ordinary skill in the art and may also be used to achieve comparable results.

Figure 6:
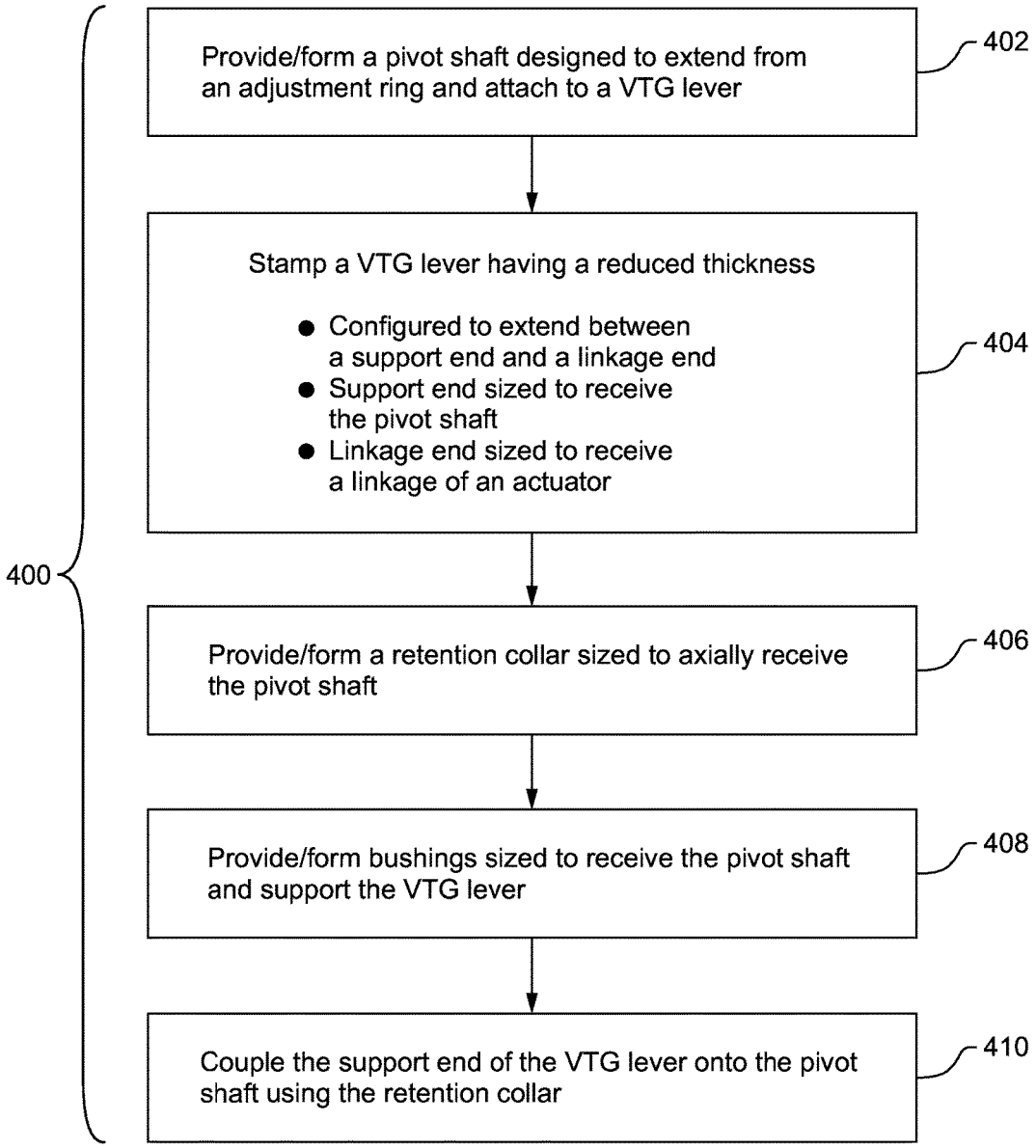
FIG. 6 is a flowchart depicting an exemplary disclosed method that may be used to manufacture a pivot shaft assembly in accordance with the teachings of the present disclosure.

Turning now to FIG. 6, one exemplary method 400 of manufacturing a pivot shaft assembly 300 of the present disclosure is provided. As shown in block 402, and in accordance with the embodiments disclosed in FIGS. 3-5, the method 400 may initially provide or form the pivot shaft 302 of the pivot shaft assembly 300. For example, in the turbocharger 202 of FIG. 2 or in other comparable VTGs, the pivot shaft 302 may be designed to extend from the adjustment ring 204 and attach to the corresponding VTG lever 306. In block 404, the method 400 may form the VTG lever 306 of the pivot shaft assembly 300 of FIGS. 3-5 with an overall reduced thickness by a suitable stamping process. Moreover, the stamping process of block 404 may be configured to form the VTG lever 306 with a support end 312 and a linkage end 314, such that the support end 312 is sized to receive the pivot shaft 302, and such that the linkage end 314 is sized to receive a linkage 236 and thereby couple to an actuator, or the like.

According to block 406 of FIG. 6, the method 400 may be configured to provide or form a retention collar 310 sized to axially receive the pivot shaft 302 of the pivot shaft assembly 300. Optionally or additionally, in block 408, the method 400 may be configured to provide or form one or more bushings 308 sized to axially receive the pivot shaft 302 and support the VTG lever 306, for instance, such that the VTG lever 306 is rigidly fit or held between the retention collar 310 and the one or more bushings 308. Still further, in block 410, the method 400 may include coupling the support end 312 of the VTG lever 306 onto the pivot shaft 302 using the retention collar 310, such as in any of the arrangements shown in FIGS. 3-5. For example, the retention collar 310 may be coupled onto the pivot shaft 302 and configured to axially abut the VTG lever 306 onto the pivot shaft 302 as shown in FIG. 4. Alternatively, the retention collar 310 may be coupled onto the pivot shaft 302, and the VTG lever 306 may be coupled onto the retention collar 310 as shown in FIG. 5. Moreover, the retention collar 310 may be coupled onto one or more of the VTG lever 306 and the pivot shaft 302 using press-fitting, welding, clinching, and/or any other suitable technique.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A pivot shaft assembly for a turbocharger with variable turbine geometry (VTG), comprising:

a pivot shaft;

a pivot fork extending from the pivot shaft;

a VTG lever disposed on the pivot shaft; and a retention collar axially coupled to the pivot shaft such that the VTG lever is axially aligned with the retention collar and the pivot shaft;

wherein the VTG lever is made by a process of stamping; and wherein the retention collar includes a radially outermost portion that is rigidly coupled to the VTG lever by welding or clinching.

2. The pivot shaft assembly of claim 1, wherein the turbocharger includes an adjustment ring and at least one vane ring, the pivot shaft being configured to extend from the adjustment ring and attach to the VTG lever.

3. The pivot shaft assembly of claim 2, wherein the adjustment ring includes an adjustment pin, the pivot fork being configured to couple to the adjustment pin of the adjustment ring.

4. The pivot shaft assembly of claim 1, wherein the VTG lever has a support end and a linkage end, the support end being pivotally coupled to the pivot shaft and the linkage end being coupled to a linkage of the turbocharger.

5. The pivot shaft assembly of claim 1, wherein the retention collar is also rigidly coupled to the pivot shaft.

6. The pivot shaft assembly of claim 1, wherein the retention collar is rigidly coupled to one or more of the VTG lever and the pivot shaft using one or more of press-fitting, welding, and clinching.

7. The pivot shaft assembly of claim 1, further comprising one or more bushings that are axially coupled to the pivot shaft such that the VTG lever is disposed between the retention collar and the one or more bushings.

8. A method of manufacturing a pivot shaft assembly for a turbocharger having variable turbine geometry (VTG), comprising:

providing a pivot shaft, the shaft having an axis;

stamping a VTG lever sized to axially receive the pivot shaft;

providing a retention collar sized to axially receive the pivot shaft, the retention collar having a radially outermost portion; and securing the VTG lever onto the pivot shaft using the retention collar; and rigidly coupling the radially outermost portion of the retention collar to the VTG lever by welding or clinching.

9. The method of claim 8, wherein the turbocharger includes an adjustment ring and at least one vane ring, the pivot shaft being formed to extend from the adjustment ring and attach to the VTG lever.

10. The method of claim 8, wherein the retention collar is also coupled to the pivot shaft, each of the VTG lever and the retention collar being axially aligned with the pivot shaft.

11. The method of claim 10, wherein the retention collar is coupled to the pivot shaft using one or more of press-fitting, welding, and clinching.

12. The method of claim 8, further providing one or more bushings sized to axially receive the pivot shaft such that the VTG lever is disposed against the retention collar.

* * * * *